US005465954A

United States Patent [19]

Takemoto et al.

[11] Patent Number: 5,465,954

[45] Date of Patent: Nov. 14, 1995

[54] PAPER MONEY CONVEYING EQUIPMENT

[75] Inventors: Takatoshi Takemoto, Tokyo; Yoshio Ito, Iwate, both of Japan

[73] Assignee: Kabushiki Kaisha Ace Denken, Tokyo, Japan

[21] Appl. No.: 205,391

[22] Filed: Mar. 3, 1994

[30] Foreign Application Priority Data

Mar. 4, 1993 [JP] Japan ..... 5-043619

[51] Int. Cl.[6] ..... B65H 9/16

[52] U.S. Cl. ..... 271/251; 271/274

[58] Field of Search ..... 271/248, 250, 271/251, 273, 274; 209/534

[56] References Cited

U.S. PATENT DOCUMENTS

| | | | |
|---|---|---|---|
| 4,588,292 | 5/1986 | Collins | 209/534 |
| 4,775,142 | 10/1988 | Silverberg | 271/274 |
| 5,022,638 | 6/1991 | Ifkovits | 271/251 |

FOREIGN PATENT DOCUMENTS

| | | | |
|---|---|---|---|
| 0473884 | 3/1992 | European Pat. Off. | 271/250 |
| 0038292 | 3/1977 | Japan | 271/274 |
| 0026635 | 2/1991 | Japan | 271/273 |
| 4055249 | 2/1992 | Japan | 271/273 |
| 4094351 | 3/1992 | Japan | 271/273 |

*Primary Examiner*—H. Grant Skaggs

*Attorney, Agent, or Firm*—Lowe, Price, LeBlanc & Becker

[57] ABSTRACT

A paper money conveying equipment, comprising a driving roller and a driven roller which rotate to convey paper money in the predetermined direction. The driven roller is supported by a supporting member and movable between a first contactable position with the driving roller and a second disengaged position from the driving roller. The driven roller is urged toward the first contactable position by the force of a coil spring. At the supporting member, a lifting member is equipped for moving the driven roller from the contactable position to the disengaged position against the urging force by the coil spring for easy removal of paper money when it causes jam between the rollers.

2 Claims, 6 Drawing Sheets

PAPER MONEY CONVEYING EQUIPMENT

BACKGROUND OF THE INVENTION

1. Field of the Invention

The present invention relates to a paper money conveying equipment for conveying paper money, and more particularly to a paper money conveying equipment suitable, usable and buildable in a money exchange machine which is installed, for example, in a game parlor. The money exchange machine uses, for exchange, the paper money paid by a game player for and collected from a plurality of game medium vending machines also installed in the game parlor.

2. Description of the Related Art

There is a known money exchange machine for a game parlor installed, for example, at the end of a game island of the game parlor, which utilizes, for exchange, paper money paid by a game player for and collected from a plurality of game medium vending machines installed in the game island. The paper money dispensed from the exchange machine is used by game players for the payment for the game medium vending machine and conveyed and collected by the paper money conveying equipment to be returned back to the exchange machine again. As shown in FIGS. 8 to 10, a conventional paper money conveying equipment comprises roller mechanisms 2 equipped along a conveying path 1. Each of the roller mechanisms 2 comprises a driving roller 3 and a driven roller 4 which are arranged opposite to each other so that the conveying path may be provided therebetween. And the driven roller 4 is urged or biased to be pressed against the driving roller 3 by a coil spring member 5.

In this connection, it is to be noted that paper money is more or less subject to damage such as folds or the like after its repeated use. Such damaged paper money would possibly cause a jam in its circulation path, and it is therefore necessary to separate damaged paper money from the rest so that only paper money in good condition may be reused for dispensing from the money exchange machine. However, this separation is not always made perfectly because there is no clear standard for judging the degree of damage, and therefore it may sometimes occur that damaged paper money is not eliminated and then mixed with the paper money which is in good condition. This might become a cause of clogging in the conveying equipment during the conveyance of the paper money.

In the conventional paper money conveying equipment, if damaged paper money is mixed into the circulation path and the equipment is clogged with the damaged paper money at a space between the driving roller 3 and driven roller 4, a cover of the paper money conveying equipment has to be opened, and then the driven roller 4 must be lifted against the force of the coil spring member 5, using leverage or the like, by inserting a screwdriver etc. into the space while taking care not to further damage the paper money. Thus, the driven roller 4 is disengaged from the driving roller 3 and the space between them is widened enough for removing the clogging paper money. As this recovery process is quite troublesome and time consuming, the circulation of the paper money is not always operated efficiently.

SUMMARY OF THE INVENTION

It is therefore an object of the present invention to provide a paper money conveying equipment which enables easy removal of paper money when the paper money conveying equipment is clogged with the paper money.

According to the present invention there is provided a paper money conveying equipment for conveying paper money from a conveying starting point to a conveying destination along a conveying path comprising:

a conveying path forming member for forming said conveying path, and a paper money conveying mechanism for conveying the paper money in the conveying path toward the destination, the paper money conveying mechanism including;

a driving roller which is provided at a position where it contacts one surface of said paper money in the conveying path and adapted to be rotated for conveying the paper money toward the destination;

a roller drive mechanism for rotating the driving roller;

a driven roller which is provided at a position opposite to the driving roller and contactable with the other surface of the paper money in the conveying path for conveying the paper money towards the destination in cooperation with the driving roller;

a driven roller support member for supporting the driven roller, allowing movement between a first position where the driven roller is contactable with the driving roller and a second position where the driven roller is apart from the driving roller;

an urging member for urging the driven roller into the first position where the driven roller is contactable with the driving roller; and a lifting member for moving the driven roller from the first position to the second position against the urging force of the urging member.

The lifting member is a lifting lever which is swingable around a fulcrum point of the driven roller support member, for moving the driven roller from the first position to the second position.

The conveying path forming member forms a conveying path having a width longer than that of the paper money, and includes a widthwise paper money guide formed along one side of the conveying path for aligning each edge of a plurality of paper money being conveyed with the paper money guide in widthwise direction. And the paper money conveying equipment further comprises a paper money pulling mechanism for pulling the paper money in said conveying path towards the widthwise paper money guide while allowing the paper money to move toward the conveying destination.

In the paper money conveying equipment as mentioned above, the paper money in the conveying path is held between the driving roller and the driven roller, and conveyed in the conveying path toward the destination according to the rotation of the driving roller. At this time, the driven roller, which is capable of moving between a first position where it is contactable with the driving roller and a second position where the driven roller gets apart from the driving roller, is urged into a first position by the urging member. Accordingly, the paper money is conveyed while being held between the driving roller and the driven roller.

During the conveyance of the paper money, if the paper money gets stuck between the driving roller and the driven roller, the lifting member may be operated to move the driven roller from the contactable position to the separated position against the urging force given by the urging member. As a result, the driven roller gets apart from the driving roller by a desired distance to widen the space between both rollers. The stuck paper money can then be removed.

DESCRIPTION OF THE PREFERRED EMBODIMENT

Figure 1:
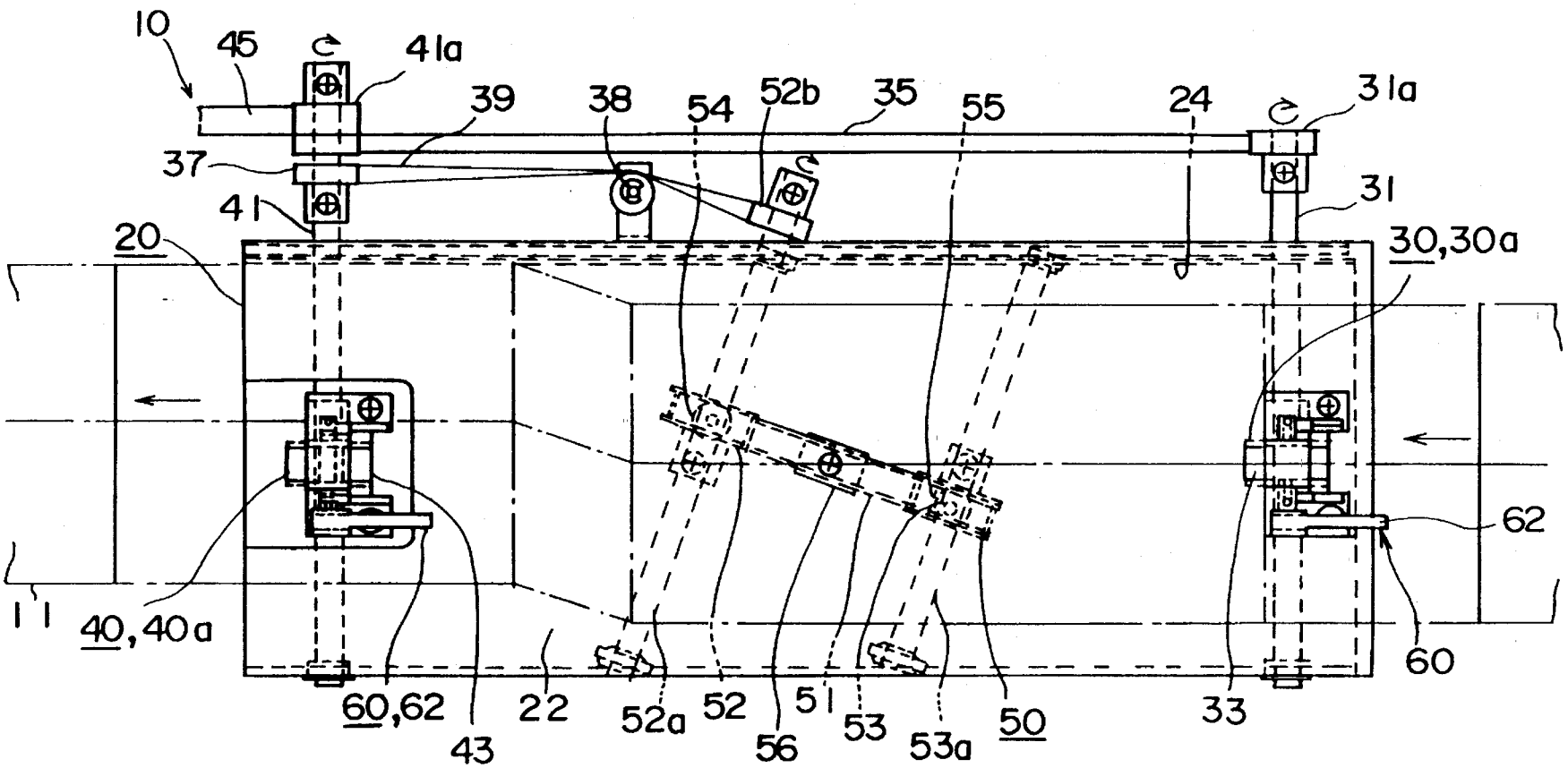
FIG. 1 is a front view of one form of a paper money conveying equipment according to the present invention.

A preferred embodiment of the present invention will now be explained referring to the drawings.

Figure 2:
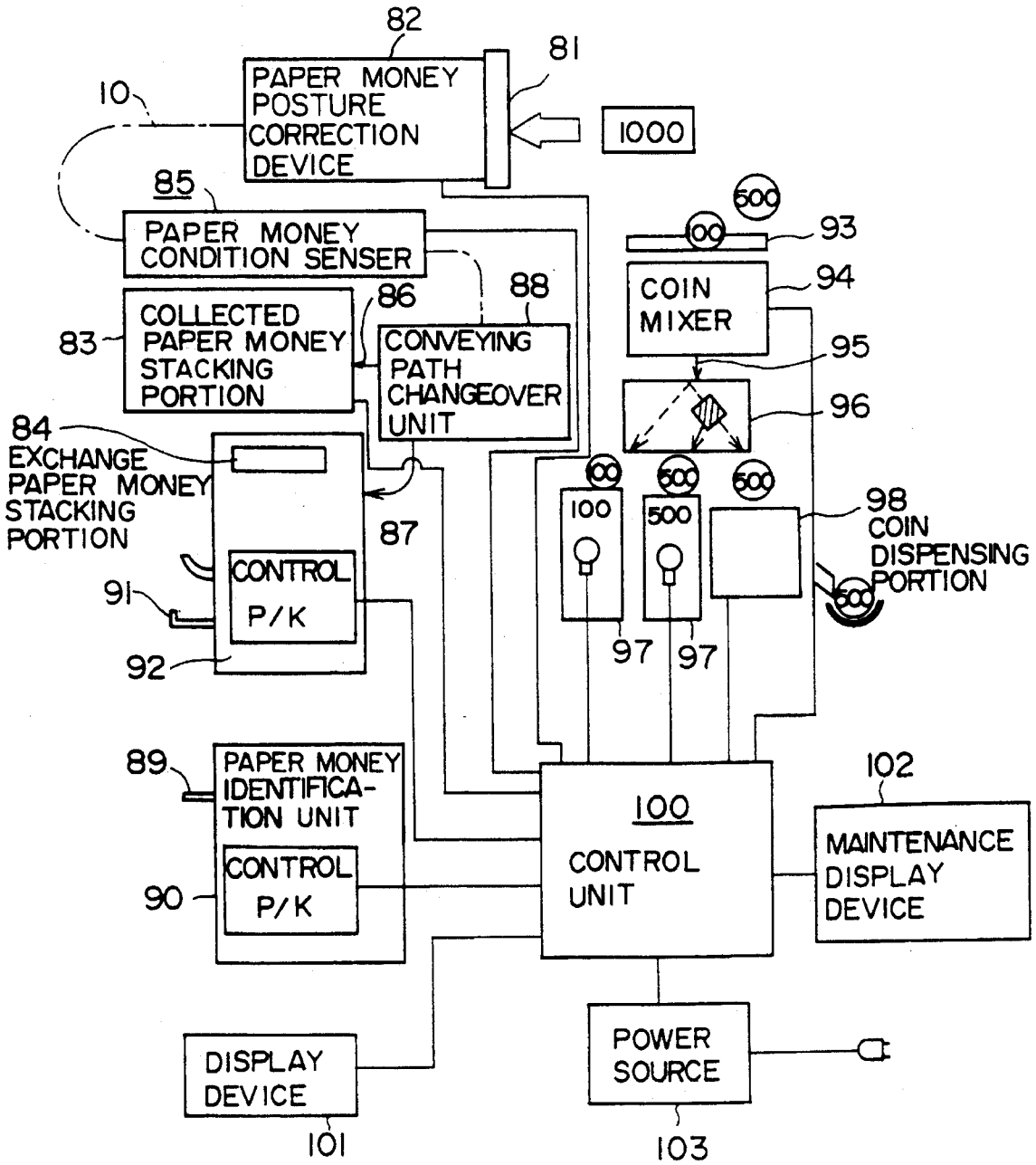
FIG. 2 is a schematic explanation diagram showing the formation of a money exchange machine suitable for use in a game parlor which is capable of employing the paper money conveying equipment according to the present invention.

FIGS. 1–7 show a preferred embodiment of the present invention. As shown in FIG. 2, the money exchange machine includes a paper money take-in portion 81 for introducing paper money collected from game medium vending machines installed in a game parlor into the money exchange machine, a paper money posture correction device 82 for correcting the posture of the paper money introduced, a paper money stacking portion 83 for stacking the collected paper money, paper money stacking portion 84 for stacking paper money for exchange, a paper money condition sensor 85, a paper money conveying equipment 10, a conveying device 86 for conveying the collected money to the stack 83, a conveying device 87 for exchange, conveying the exchange money to the stack 84, and a conveying path changeover unit 88 for changeover of the path to 83 or 84, a paper money take-in portion 89 for exchange, a paper money identification unit 90, an identified paper money conveying device (not shown), an exchange paper money dispensing portion 91, a dispensing paper money conveying portion 92, a coin take-in portion 93, a coin mixer 94, and a coin conveying portion 95 for sorting, a coin sorter device 96, a coin stacking portion 97, a coin dispensing portion 98, a control unit 100, a display device 101, a maintenance display device 102, and a power source 103.

The control unit 100 controls the paper money posture correction device 82, the collected paper money stacking portion 83, the exchange paper money stacking portion 84, the paper money condition sensor 85, the conveying path changeover unit 88, the paper money identification unit 90, the coin mixer 94, the coin sorter device 96, the coin stacking portion 97, the display device 101 and the maintenance display device 102. The control unit 100 includes a paper money condition determination device.

The collected paper money take-in portion 81 is an intake for the paper money collected from the game medium vending machines which receives paper money and coins paid by game players and dispenses game media (not shown) therefore. The paper money conveying equipment 10 includes belts and rollers and conveys the paper money from the collected paper money take-in portion 81 to the paper money condition sensor 85 via the paper money posture correction device 82.

The paper money conveying equipment 10 has a function to correct the position of the paper money in the widthwise direction or correct the slanting or skew in the conveying path.

As shown in FIG. 1 and FIGS. 3 to 7, the paper money conveying equipment 10 includes a path forming member 20 for forming a paper money conveying path 11, and a first roller mechanism 30 for conveying the paper money in the conveying path 11 and a second roller mechanism 40 similar to the first roller mechanism 30 and a pulling mechanism 50 for diagonally sending the paper money to one side of the conveying path to true up an edge of the paper money along the side.

Figure 4:
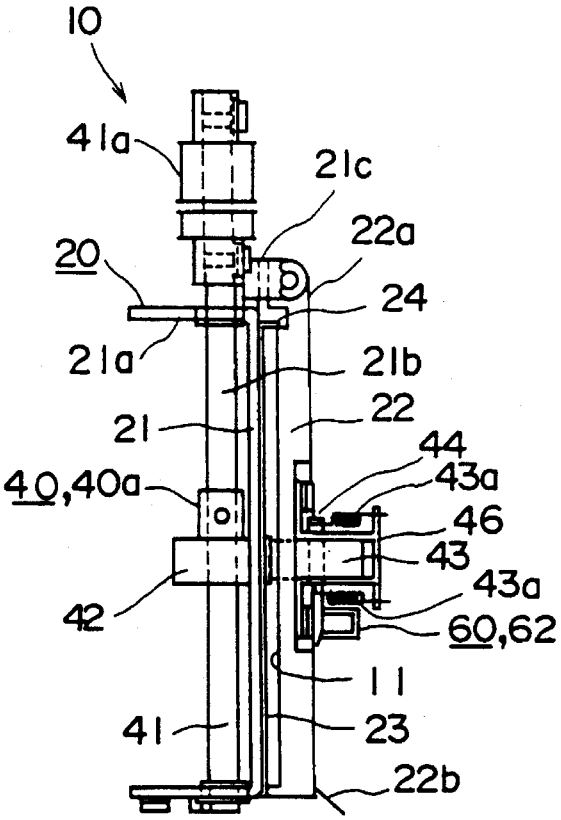
FIG. 4 is a left side view of the paper money conveying equipment shown in FIG. 1.

The path forming member 20 has a support plate 21, a first guide member 22, and a second guide member 23. The support plate 21 extends in a conveying direction, and its side portions **21*a* are folded at a right angle rearwardly. Thus, the support member is formed in a channel-shape. As to the conveying direction in FIG. 1, the right side is upstream, and the left side is downstream. The second guide member 23 is provided at a front side 21*b* of the support plate 21. As shown in FIG. 4, one side end of the second guide member 23 is folded forwardly to form a paper money guide 24**.

Figure 3:
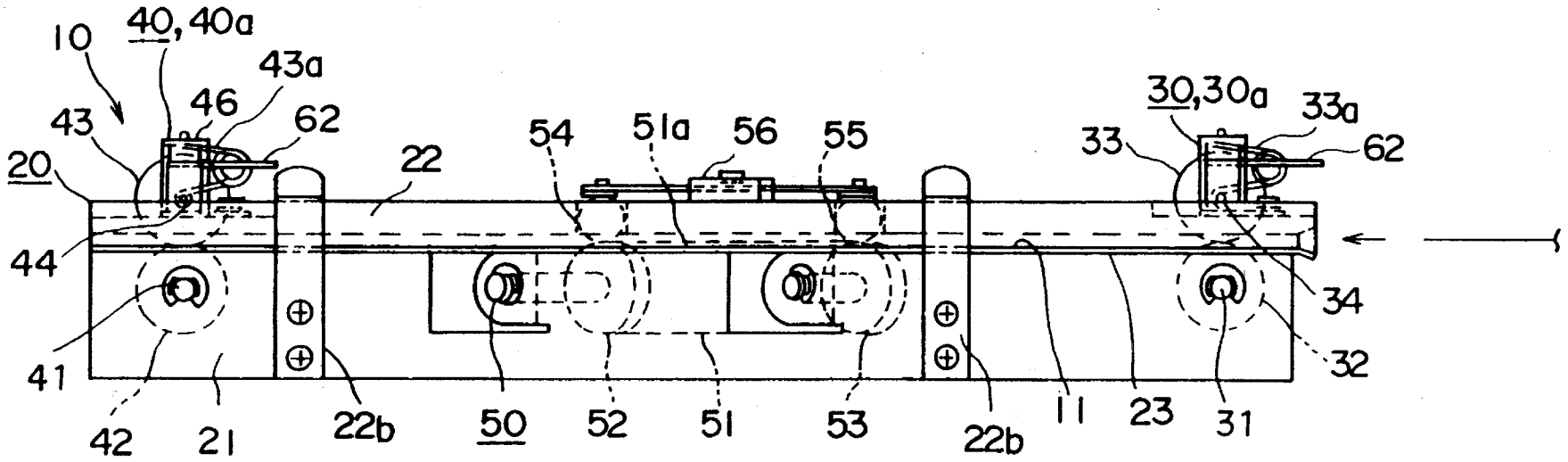
FIG. 3 is a bottom view of the paper money conveying equipment shown in FIG. 1.

The first guide member 22 covers the front side of the second guide member 23. As shown in FIG. 3, the path forming member 20 forms a paper money conveying path 11 between the first guide member 22 and the second guide member 23. The paper money guide 24 forms one side wall of the paper money conveying path 11 in the widthwise direction.

The first roller mechanism 30 has a rotating shaft 31 and a driving roller 32 mounted on the rotating shaft 31, and a driven roller 33 confronting the driving roller 32. The driven roller 33 is rotated by the frictional force transmission by the driving roller 32. Similarly, the second roller mechanism 40 has a rotating shaft 41, driving roller 42 mounted on the rotating shaft 41, and a driven roller 43 confronting the driving roller 42, and rotated by the frictional force transmission by the driving roller 42.

The rotating shafts 31, 41 extend in the direction traversing the conveying direction in which the path forming member 20 extends. The rotating shafts 31, 41 extend through the sides **21*a* of the support plate 21 and are rotatably supported thereby. As shown in FIG. 3, a part of the driving rollers 32, 42, is projected into the paper money conveying path 11 through an opening formed in each of the support plate 21 and the second guide member 23. A part of each of the driven rollers 33 and 42 is projected into the paper money conveying path 11 through an opening formed in each of the first guide member 22. A shaft 34 around which the driven roller 33 in the first roller mechanism 30 is mounted is supported by the first guide 22 through a support member 36. The rotating shaft 34 for the driven roller 33 is urged or biased by the force of a coil spring 33***a* in a direction to bias the driven roller 33 into a position where the driven roller 33 is contactable with the driving roller 32. A shaft 44 for the driven roller 43 in the second roller mechanism 40, like the shaft 34 for the driven roller 33, is supported by the first guide member 22 through a supporting member 46. The driven roller 43 is biased by the force of a coil spring 43*a* in such a direction that the driven roller moves to a position contactable with the driving roller 42.

A distance between the first roller mechanism 30 and the second roller mechanism 40 is set longer than the length of the paper money. At one end of each rotating shaft 31, 41, a pulley 31*a* or a pulley 41*a* is equipped respectively, and between the pulleys 31*a* and 41*a* an endless belt 35 is provided. Between the pulley 41*a* and a driving shaft of the motor (not shown), a driving belt 45 is provided.

Thus, by the driving of the motor, the first roller mechanism 30 and the second roller mechanism 40 rotate at the same speed in synchronism with each other. The paper money, which is held between the driving roller 32 and the driven roller 33 in the first roller mechanism 30 is conveyed downstream along the paper money conveying path 11 as these rollers 32 and 33 rotate. The paper money is then introduced and held between the driving roller 42 and the driven roller 43 of the second roller mechanism 40 and then conveyed further downstream along the path according to the rotation of these rollers 42 and 43.

As shown in FIGS. 1, 3 and 4, each roller mechanism 30 and 40 has a respective lifting mechanism 60.

The structural explanation between the roller mechanism and the lifting mechanism will now be made with reference to the relation between the first roller mechanism 30 and the lifting mechanism 60.

Figure 5:
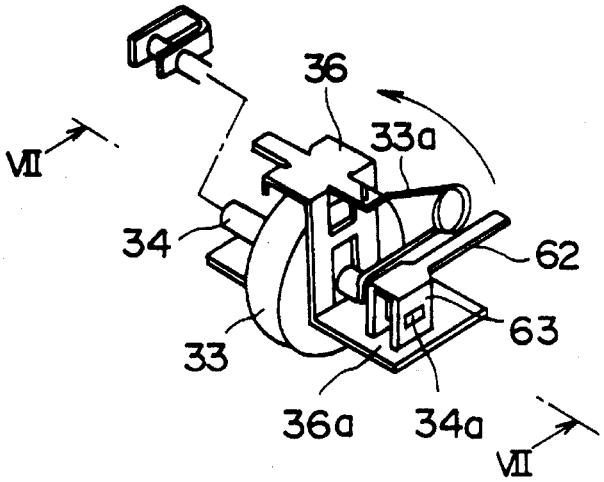
FIG. 5 is a perspective view of a part of a roller mechanism employable in the paper money conveying equipment according to the present invention.
Figure 6:
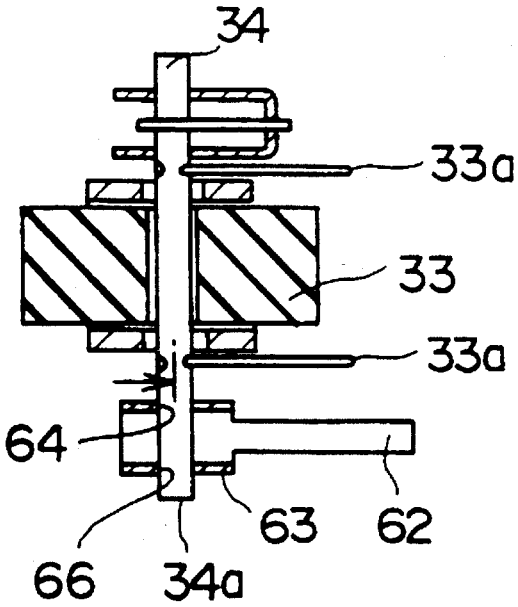
FIG. 6 is a sectional view of the roller mechanism of the paper money conveying equipment according to the present invention.
Figure 7:
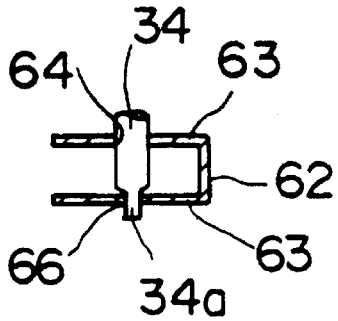
FIG. 7 is a sectional view of a lifting member employable in the roller mechanism taken along a line VII—VII of FIG. 5.
Figure 8:
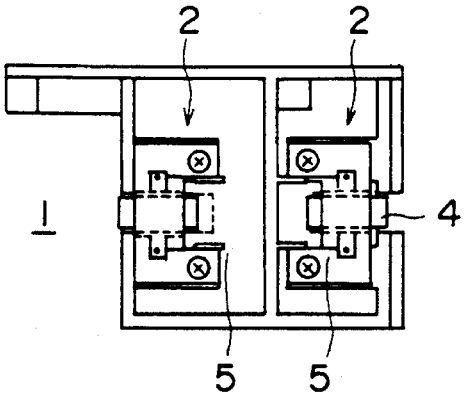
FIG. 8 PRIOR ART
FIG. 8 is a front view of a roller mechanism of a prior art.
Figure 9:
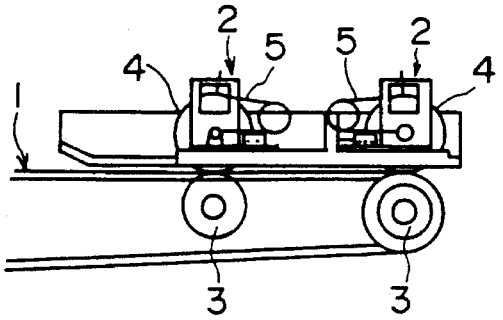
FIG. 9 PRIOR ART
FIG. 9 is a bottom view of the roller mechanism with a conveying path of a prior art.
Figure 10:
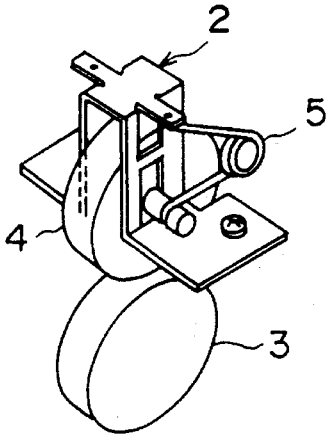
FIG. 10 PRIOR ART
FIG. 10 is a perspective view of a part of the roller mechanism of a prior art.

As shown in FIGS. 5 and 6, the lifting mechanism 60 has a lifting lever 62 at its tip end. The lifting lever 62 has a portion base formed in reversed U-shape. The reversed U-shape portion has walls 63. One of the walls 63 has an opening 64 through which the rotating shaft 34 of the first roller mechanism 30 extends, while the other wall 63 of the reversed U-shape has a key groove 66 in which a key portion 34*a* formed at one end of the rotating shaft 34 fits so that the shaft 34 may not rotate relatively. Here, the shaft 34 itself does not rotate with the rotation of the driven roller 33, but the driven roller 33 rotates around the shaft 34. The wall portion 63 of the lever 62 rest on with a base portion 36*a* of the supporting member 36. A part of the contact point of the wall portion 63 with the base portion 36 may function as a fulcrum of the lever.

When the tip end of the lifting mechanism 60 is lifted with the lever 62, the rotating shaft 34 is moved around the fulcrum of the lever, to the separated, second position to widen a space between the driving roller 32 and driven roller 33 for removing the paper money jamming the rollers.

The pulling mechanism 50 for pulling the paper money to one side of the conveying path is mounted between the first roller mechanism 30 and the second roller mechanism 40. The pulling mechanism 50 comprises an endless belt 51, a driving pulley 52, a driven pulley 53, and rotating bodies 55, 54 constituted of two steel balls, and a rotating support member 56.

Rotating shafts 52*a*, 53*a* of the driving pulley 52, and the driven pulley 53 are rotatably mounted at a side portion of the support plate 21. The rotating shafts 52*a* and 53*a* are, as shown in FIG. 1, slanting in the widthwise direction with reference to the paper money conveying path 11. The driving pulley 52 is positioned closer to the paper money guide 24 than the driven pulley 53 and the driving pulley 52 and the driven pulley 53 both partly project into the paper money conveying path 11 through the opening formed on the support plate 21.

An end portion of the rotating shaft 52*a* projected from the paper money conveying path 11 is equipped with a pulley 52*b*. Between the pulley 52*b* and a pulley 37 which is equipped with the rotating shaft 41 in the second roller mechanism 40, an endless belt 39 is engaged through a pulley 38 projected from the support plate 21. Thus by the driving of the motor, the driving roller 32 in the first roller mechanism 30 and the driving roller 42 in the second roller mechanism 40 and the endless belt 51 in the pulling mechanism 50 are made to rotate in synchronism with each other at the same speed.

The conveying surface of the endless belt 51 is, as shown in FIG. 1, slanting with respect to the longitudinal direction of the paper money guide.

The rotating support member 56 is mounted to the first guide member 22, and rotatably supports the two rotating bodies 54, 55 in the opening of the first guide member 22. The two rotating bodies 54, 55 are disposed so as to oppose the driving pulley 52 and the driven pulley 53 respectively, across the conveying path 11, and are biased towards the driving pulley 53 and the driven pulley 52 by the biasing force of the rotating support member 56.

The force of the two rotating bodies 54, 55 with the endless belt 51 is adjusted to be weaker than those of the first roller mechanism 30 and the second roller mechanism 40. The two rotating bodies 54, 55 are arranged to project into the conveying path 11 through the opening in the upper guide 22, so that the paper money can be held between them and the conveying surface 51*a* of the endless belt 51.

A distance between the rotating bodies 54, 55 in member 50 and the first roller mechanism 30 in the upstream portion, and also a distance between the rotating bodies 54, 55 and the second roller mechanism 40 in the downstream portion are each set shorter than the length of the paper money.

Now, the operation will be explained.

In FIG. 1, when paper money is inserted into the conveying path 11 which is provided between the first guide member 22 and the second guide member 23 in the path forming member 20, the paper money is held between the driving roller 32 and the driven roller 33 in the first roller mechanism 30 and conveyed downstream of the paper money conveying path 11 according to the rotation of these rollers 32, 33. The paper money is then introduced between the conveying surface 51*a* of the endless belt 51 in the pulling member 50 and the rotating body 55 of upstream side but conveyed keeping the same posture according to the movement of the endless belt 51 at the same speed and direction.

The paper money maintains its speed and direction in moving, for the following reason. The rotating bodies 54,55 are in contact with the endless belt 51 urged by the force of the rotating support member 56. However, the pushing force given to the paper money by the rotating bodies 54, 55 and the endless belt 51 is weaker than that of the first roller mechanism 30, and also the rotating bodies 54,55 and the endless belt 51 is contacted only at a point, and therefore the conveying force of the first roller mechanism 30 is stronger than that of mechanism 50.

The conveying surface 51*a* of the endless belt 51 moves in a slanting direction with reference to the paper money conveying path 11.

Therefore when the end of the paper money leaves and disengaged from the first roller mechanism 30, the paper money changes its direction in accordance with the moving direction of the conveying surface 51*a* of the endless belt 51 and moves toward the paper money guide 24. When the upper front end of the paper money touches the paper money guide 24, the paper money changes its direction according to the paper money guide 24, and goes along the paper money conveying path 11.

At this time, the paper money is supported by the two rotating bodies at respective contacts in cooperation with the endless belt 51 at the opposite side. Each of the rotating bodies 54, 55, capable of rotating in all directions, rotates and moves depending upon the conveying direction of the paper money while supporting the paper money. Therefore if the paper money skews during the conveyance, the skew is corrected and the paper money can be conveyed to the predetermined destination with correct angle.

The paper money then proceeds along the paper money guide 24 with its long side aligned with the guide 24. When the front end of the paper money reaches the second roller mechanism 40, the paper money is held between the driving roller 42 and driven roller 43 of the second roller mechanism 40, then it proceeds to the conveying destination according to the rotation of the second roller mechanism 40.

During the conveyance of the paper money, the rotating shaft 34 is in the contactable position so that the driven rollers 33, 43 are in the contactable position with the driving rollers 32 and 42.

For example, if the space between the driven roller 33 and the driving roller 32 is choked with paper money, the lifting lever 62 may be lifted up against the biasing force given by the coil spring 33*a* with the leverage. As a result of this, the contact point between the side wall 63 of the lever 62 and the base portion 36*a* of the supporting member 36 functions as the fulcrum for the lever 62 to swing the side wall 63 to move the rotating shaft 34, supported by the wall portion 63 of the lever 62, to the second, disengaged position. Thus, a space for taking out the clogging paper money may be provided between the driving roller 42 and the driven roller 43. Thanks to this structure, without using any tools, such as a screwdriver or the like, the clogging paper money can be removed easily. After the paper money is removed, by letting the lever go, the rotating shaft will return to its original contactable position due to the biasing force, and both the driving roller 33 and the driven roller 32 will be back into a contactable state again.

In the aforementioned preferred embodiment, a lifting mechanism 60 having a lever 62 is explained. However, the invention is not necessarily limited to this type. As an alternative, a shaft 34, 44 may be lifted up against the urging of the coil spring 33*a*, 43*a* by a cam, for example.

What is claimed is:

1. A paper money conveying equipment for conveying paper money from a conveying starting point to a conveying destination along a conveying path comprising:

a conveying path forming member for forming said conveying path, and a paper money conveying mechanism for conveying said paper money in said conveying path toward said destination, said paper money conveying mechanism including;

a driving roller which is provided at a position where it contacts one surface of said paper money in said conveying path and adapted to be rotated for conveying the paper money toward said destination;

a roller drive mechanism for rotating said driving roller;

a driven roller which is provided at a position opposite to said driving roller and contactable with the other surface of said paper money in said conveying path for conveying said paper money towards said destination in cooperation with said driving roller;

a driven roller support member for supporting said driven roller, allowing movement between a first position where the driven roller is contactable with the driving roller and a second position where the driven roller is apart from the driving roller;

an urging member for urging said driven roller in said first position where said driven roller is contactable with the driving roller; and a lifting member for moving said driven roller from said first position to said second position against the urging force of said urging member;

said driven roller comprising:

a cylindrical roller body whose periphery comes into contact with another surface of said paper money, and a rotary shaft provided at a central axis of said roller body;

said driven roller support member comprising a contacted support portion with which said lifting member comes into contact;

said lifting member comprising:

a shaft fixing portion to which said rotary shaft of said driven roller is to be fixed, a contacting section to contact said contacted support portion of said driven roller support member, and an operation section formed on a side opposite to said contacting portion with respect to said shaft fixing portion located therebetween, and provided at a position farther from said shaft fixing portion than said contacting portion from said shaft fixing section;

said lifting member is a lifting lever which is swingable around a fulcrum point of said contacted support portion, when said operation portion is held up to move, said driven roller positioned at said first position to said second position.

2. A paper money conveying equipment according to claim 1, wherein said conveying path forming member forms a conveying path having a width longer than that of said paper money, and includes a widthwise paper money guide formed along one side of said conveying path for aligning each edge of a plurality of paper money being conveyed with said paper money guide in widthwise direction, and which further comprises a diagonal paper money sending mechanism for diagonally sending said paper money in said conveying path towards said widthwise paper money guide while allowing said paper money to move toward said conveying destination.

* * * * *